United States Patent [19]

Bennett

[11] Patent Number: 4,496,327

[45] Date of Patent: Jan. 29, 1985

[54] EDUCATIONAL GAME

[76] Inventor: Robert A. Bennett, 11042 Lakeview Dr., Whitehouse, Ohio 43571

[21] Appl. No.: 440,876

[22] Filed: Nov. 12, 1982

[51] Int. Cl.[3] ..... A63F 3/00

[52] U.S. Cl. ..... 273/249; 273/282

[58] Field of Search ..... 273/249, 248, 243, 251, 273/272, 284, 282; 434/167

[56] References Cited

U.S. PATENT DOCUMENTS

| | | | |
|---|---|---|---|
| 1,338,493 | 4/1920 | Cress | 273/248 |
| 1,904,723 | 4/1933 | Fisher | 434/167 |
| 2,006,176 | 6/1935 | Quine | 273/248 |
| 3,104,106 | 9/1963 | Kenny et al. | 273/249 |
| 3,215,435 | 11/1965 | Rheingruber | 273/249 |
| 3,984,106 | 10/1976 | White | 273/243 |
| 4,035,932 | 7/1977 | Massey | 434/167 X |
| 4,055,347 | 10/1977 | Kreischer | 273/272 X |

FOREIGN PATENT DOCUMENTS

| | | | |
|---|---|---|---|
| 1512932 | 2/1968 | France | 273/251 |
| 515188 | 11/1939 | United Kingdom | 273/249 |

OTHER PUBLICATIONS

"Seven League Boots" Games and Puzzles Magazine, Sep. 1977.

"Alphabet Game", Cleo Learning Aids Catalog, Feb. 1976.

*Primary Examiner*—Paul E. Shapiro

*Assistant Examiner*—Scott Brown

*Attorney, Agent, or Firm*—Fraser & Clemens

[57] ABSTRACT

An educational game is provided wherein a random path from a start position to a goal position is divided into at least twenty-six spaces and such spaces are labelled with the letters of the alphabet in proper sequence. Playing cards containing numbers are provided and the drawing of a card permits the child to move his marker to a space on the path by advancing the number of spaces indicated on the card drawn. Cards bearing letters are also incorporated to permit the advance or backward movement of the marker to the letter displayed on the card drawn. Thus, the child learns both letters of the alphabet and numbers.

10 Claims, 7 Drawing Figures

EDUCATIONAL GAME

BACKGROUND OF THE INVENTION

1. Field of the Invention

This invention comprises a children's game for promoting the recognition of numbers, alphabet letters and simple words by the player.

2. History of the Prior Art

There is a long recognized need for advancing the preschool education of children to the point that they have achieved alphabet and number recognition and even reading recognition of simple words prior to entering their formal grade school training. Children that have this ability have a distinct advantage in the early grades of school over those who enter school without such ability. Unfortunately, preschool training is generally not available on a no fee basis, hence parents with limited incomes are effectively precluding from giving their children this head start along their educational path.

Alphabet and number recognition games have heretofore been proposed. See for example U.S. Pat. Nos. 1,210,614 to Dorer, 3,811,206 to Gaccetta, 3,815,919 to Cain et al. and, 3,853,321 to Claffie. While each of these prior art games does involve alphabet recognition, and in the case of the Gaccetta patent, recognition of a few words, each such games is limited in that once alphabet recognition or the limited number of words recognition has been achieved by the player, the game is of no further educational value to the particular child. Additionally the contest created by the game is too complicated and not interesting to a pre-school child.

There is a need, therefore, for an educational game providing contest interest to the pre-school child wherein the child can progress in his recognition from number and alphabet characters to simple three letter words, and thence to more complicated words.

SUMMARY OF THE INVENTION

This invention contemplates a playing board which may be either of flat, two dimensional configuration, bearing a picture thereon, or a three dimensional configuration. With either type of playing board, a random path is printed or formed on the playing board from a beginning area to a goal spot for winning the game. The random path is divided into a plurality of spaces, at least twenty-six discrete spaces if the full alphabet is utilized.

For a child that has had no prior educational training, adhesive backed labels can be provided, each bearing a letter of the alphabet and these labels are applied in proper sequence to the spaces on the random path. A deck of cards is then provided with the cards carrying numerals and a limited number of cards carrying some of the same alphabet characters as the path. As a child draws a card, he (or she) is encouraged to count the indicated number of spaces and then pronounce the corresponding letter on the random path provided on the playing board. The child can then advance his marker or playing piece to that position. The alphabet cards drawn by the child may permit him to either advance on the path up the mountain, if he draws a letter of the alphabet following the letter on which his marker is resting, or he may have to retreat down the path if he draws a letter preceding that on which his marker is resting.

The cards introduced into the playing deck bearing numbers teach number recognition and facilitate counting. The drawing of a card with a number will permit the child to advance his marker the number of spaces represented by the number of the card. The alphabet cards add an element of risk with the possibility of moving in either direction and more spaces than the highest number card.

To add an additional element of suspense to the game, the random path may include a plurality of spaces labeled "Draw Again" or the equivalent. Likewise, cards bearing the legend "Draw Again" may be included in the pack and the drawing of such cards will permit the child to advance his marker to the next "Draw Again" space above the current position of his marker on the random path.

After the child has mastered recognition of the alphabet and the number characters, new adhesive labels may be applied to the spaces in the random path carrying simple three letter words, and a corresponding deck of cards provided. The game would be played the same, but now the child is required to recognize the word appearing on the space where he is to move and to move his marker to the space on the random path bearing the same word.

Further objects and advantages of the invention will be readily apparent to those skilled in the art from the following detailed description, taken in conjunction with the annexed sheets of drawings on which is shown a preferred embodiment of the invention.

DESCRIPTION OF PREFERRED EMBODIMENT

Figure 1:
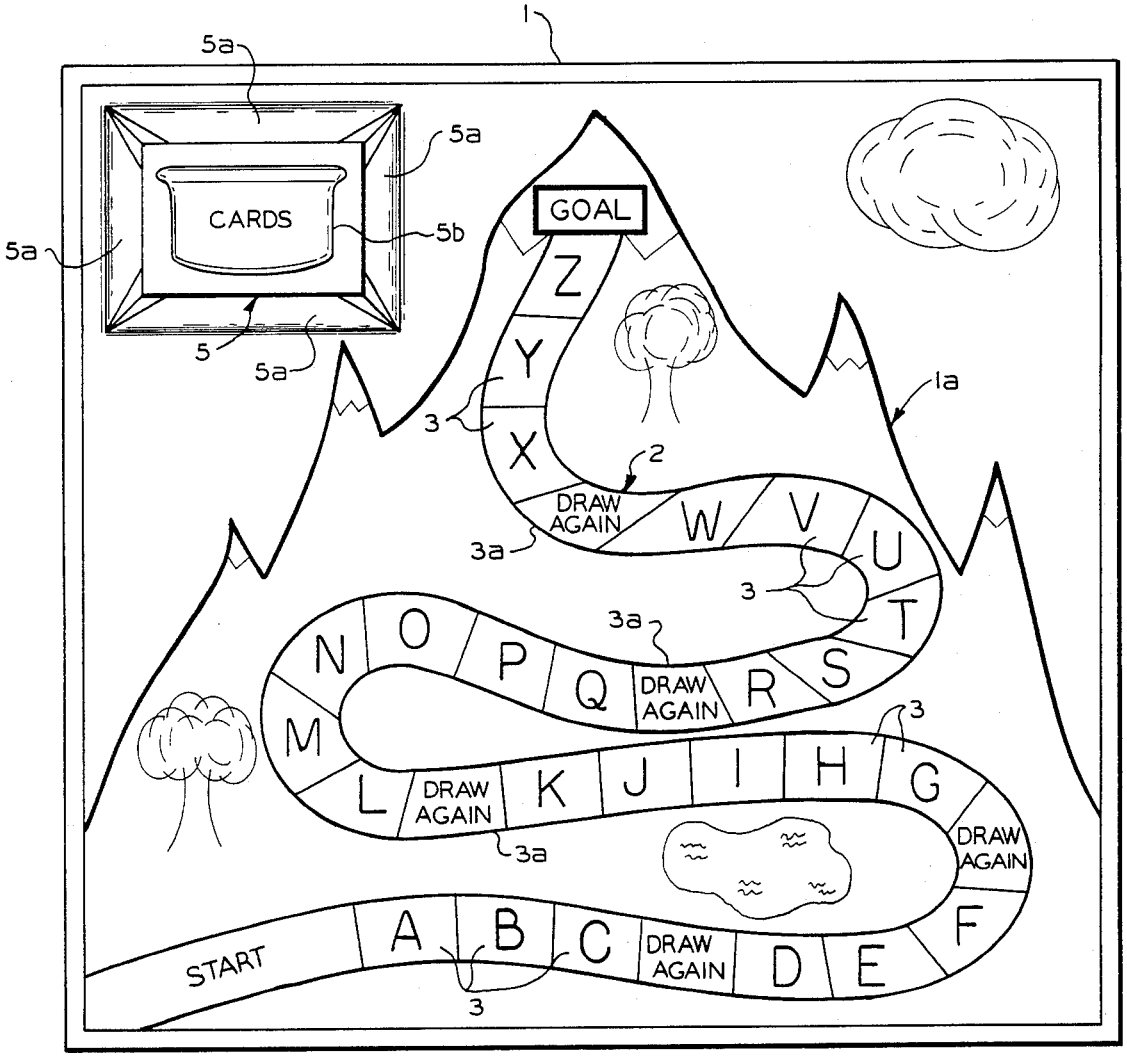
FIG. 1 is a top plan view of a game board embodying the invention.

Referring to FIG. 1, there is illustrated a playing board 1 embodying this invention. As illustrated, the board 1 is of flat, two dimensional configuration bearing thereon the graphical illustration of a mountain 1*a*. Alternatively, the playing board 1 may be fabricated in three dimensional form to provide a realistic representation of a mountain, but of course, at considerably increased cost. Furthermore, although a mountain has been illustrated, any random path representation would be suitable.

Figure 2:
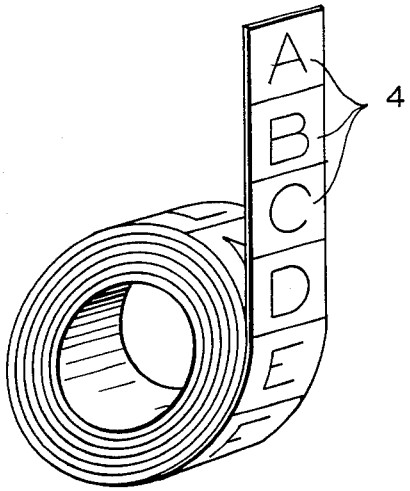
FIG. 2 is a schematic perspective view of adhesive labels bearing alphabet characters for application to the game board.

In either event, a random path 2 ascending the mountain is outlined thereon. Path 2 extends from a area labelled "START" to an area at the top of the mountain labelled "GOAL". Intermediate the "START" and "GOAL", the path 2 is divided into a plurality of sequential spaces 3. A minimum of twenty-six such spaces must be provided in order to respectively accommodate a letter of the alphabet which may be printed thereon, or applied by printing on an adhesively backed label 4 (FIG. 2). Preferably a number of spaces 3 greater than twenty-six is provided and at random intervals, such additional spaces 3*a* are labelled "DRAW AGAIN" or an appropriate symbol indicating that the player can draw another card, as will be subsequently explained. Also, although upper case letters are shown, lower case letters could be utilized, either alone or in combination with the upper case letters.

Figure 4:
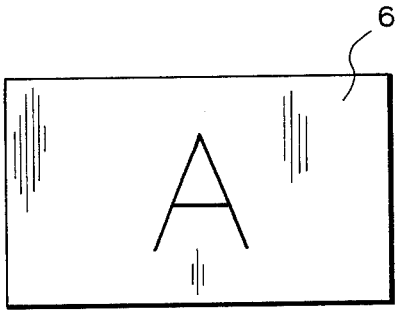
FIG. 4 is a plan view of a playing card corresponding to the alphabet recognition labels shown in FIG. 2.

At a convenient location on the playing board 1, a magazine area 5 for holding a deck of playing cards is indicated. Preferably, the area 5 is defined by upstanding tabs 5*a* which are cut from the body of the board 1 and define a rectangular area to accommodate the playing cards 6 (FIG. 4). If desired, the playing card area 5 may be pictorially represented as a pot 5*b* and then the legend of a pot applied to the spaces 3*a* to indicate that the player should draw again. Of course, any picture could be utilized in place of the pot 5*b*.

Figure 7:
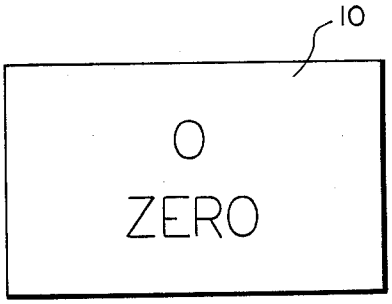
FIG. 7 is a view similar to FIG. 4 of a playing card corresponding to numbered cards.

For the beginning player, i.e., a child who has not achieved alphabet or number recognition, the cards 6 will respectively contain a series of numbers plus a limited number of cards bearing letters. Each player is provided with a suitable marker (not shown) and which are all positioned at the "START" space at the beginning of the game. Each child successively draws a card 6 from the card magazine 5. Such card will contain a number which the child is encouraged to orally identify and then he may move his marker that number of spaces to one of the spaces carrying a letter of the alphabet. Typically, the numbers are zero (card 10 shown in FIG. 7) through nine or ten to extend the game a reasonable length of time.

To permit the child to concurrently acquire alphabet recognition, the child is encouraged to orally identify the letter of the space 3 on which he lands. Furthermore, a number of cards 6 containing letters of the alphabet are included in the stack. The drawing of a card bearing a letter permits the child to advance or return along the random path 2 to the space corresponding to the letter drawn. In the event that the next draw by a player is a letter appearing in the alphabet subsequent to the letter on which his marker is resting, the child may advance his marker to the letter drawn. On the other hand, if the letter drawn precedes the letter of the alphabet on which the child's marker is resting, he must retreat his marker down the path 2 to the new letter. Thus, the progress of the child's marker along the random path 2 is determined solely by the luck of the draw and an interesting element of suspense is added to the game, particularly when the child draws a letter in order to finally advance from the letter spaces to the "GOAL".

Figure 6:
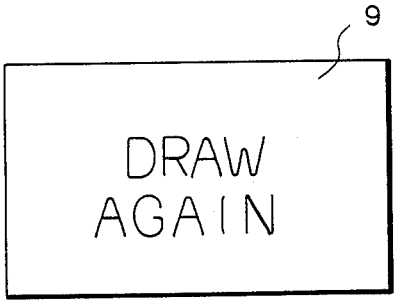
FIG. 6 is a view similar to FIG. 4 of a playing card corresponding to the draw again spaces shown in FIG. 1.

An additional element of interest may be incorporated in the game by including a number of cards card 9 shown in FIG. 6. labelled either "DRAW AGAIN" or showing the pictorial representation of the pot representing the stack of cards. The drawing of such cards means that the child may advance his marker upwardly along the path 2 to the next space bearing the legend "DRAW AGAIN" or showing the pictorial representation of the pot. If the marker is between the last "DRAW AGAIN" space and the "GOAL", the child may be required to move back to the "DRAW AGAIN" space. Also, during play, the child's marker can land on a "DRAW AGAIN" space when moving the number of spaces indicated on one of the number cards. At this point, the child may be allowed to draw another card.

Figure 3:
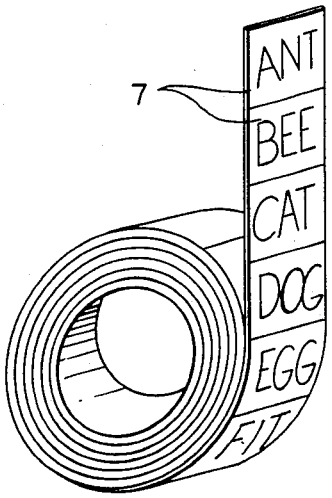
FIG. 3 is a view similar to FIG. 2 but illustrating adhesive labels bearing simple three letter words for application to the game board.
Figure 5:
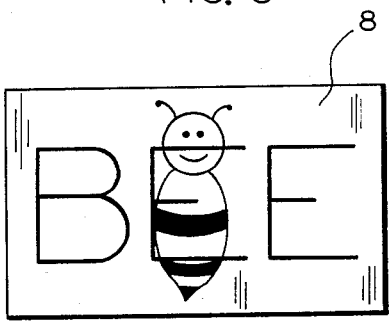
FIG. 5 is a view similar to FIG. 4 of playing cards corresponding to the word recognition labels shown in FIG. 3.

A particularly valuable feature of the aforedescribed educational game is that its educational value is not lost once the child has mastered alphabet and numeral recognition. This is accomplished by providing additional adhesive labels 7 (FIG. 3) bearing simple three letter words arranged in alphabetical sequence as illustrated in FIG. 5. Additionally, if desired, the labels 7 may also contain a pictorial illustration of the three letter word. Thus, the word "cat" will have a picture of a cat, "dog" will have a picture of a dog. The labels 7 are then applied to the path 2 and a new set of playing cards 8 (FIG. 5) bearing the three letter words and, if desired, the pictorial representation of such three letter words are substituted for the alphabet cards in the stack of playing cards contained in the magazine 5.

The playing of the game proceeds as before with the child being encouraged to orally identify each three letter word either before or after he moves his marker to the same word appearing on the random path 2. The incorporation of cards bearing words and "DRAW" legends will add to the suspense of the game in the same manner as previously described.

Those skilled in the art will recognize that the educational utility of the described game may be greatly expanded. A set of more complicated words can be applied by a new set of adhesive labels and the word recognition of the child is expanded through playing the game with the new words applied to the random path 2 and with playing cards carrying the new words and, if desired, a pictorial representation of such.

Modifications of this invention will be readily apparent to those skilled in the art and it is intended that the scope of the invention be determined solely by the following claims.

What is claimed is:

1. An educational game comprising a playing board, means defining a random path on said board extending from a starting position to a goal position; said random path comprising a sequence of spaces containing educational characters selected from a group of letters of the alphabet and simple words, said letters of the alphabet being arranged in proper sequence from said start position to said goal; a set of playing cards, at least one of said cards having one of said educational characters represented thereon and a plurality of number cards each having a number represented thereon; and a marker for each player; said marker being moved toward or away from said goal to the educational character on said path corresponding to the educational character appearing on said one card when drawn by the player and whereby a player drawing a number card may advance said player's marker a number of said spaces corresponding to the number on the drawn card.

2. An educational game in accordance with claim 1 wherein said educational characters are arranged in an alphabetical sequence of simple words.

3. An educational game in accordance with claim 2 wherein said spaces respectively contain a pictorial representation of each said simple word.

4. An educational game in accordance with claim 1 or 2 wherein said random path contains a plurality of randomly distributed spaces labelled "Draw Again", whereby the player whose said marker lands on any one of said "Draw Again" spaces may pick another card from said set of cards.

5. An educational game in accordance with claim 1 or 2 wherein said random path contains a plurality of randomly distributed spaces labelled "Draw Again", whereby the player whose said marker lands on any one of said "Draw Again" spaces may pick another card from said set of cards, said set of cards containing a plurality of cards having "Draw Again" represented thereon, whereby the player drawing one of said "Draw Again" cards may advance his marker on said path to the next one of said "Draw Again" spaces.

6. An educational game comprising a playing board, means defining a random path on said board extending from a starting position to a goal position, said random path comprising a sequence of spaces; a plurality of labels respectively adhesively secured to said spaces, said labels having printed educational characters thereon comprising letters of the alphabet arranged in proper sequence from said start position to said goal; a set of playing cards, each card having an educational character represented thereon and including a plurality of number cards having numerical educational characters represented thereon; and a marker for each player, said marker being moved toward or away from said goal to the educational character on said path in accordance with the educational characters appearing on the successive cards drawn by the player and whereby a player drawing a number card may advance said player's marker a number of said spaces corresponding to the number on the drawn card.

7. An educational game in accordance with claim 6 wherein said educational characters on said labels on said random path include an alphabetical sequence of simple words.

8. An educational game in accordance with claim 7 wherein said labels respectively contain a pictorial representation of each said simple word.

9. An educational game in accordance with claim 6 wherein said random path contains a plurality of randomly distributed spaces labelled "Draw Again", whereby the player whose said marker lands on any one of said "Draw Again" spaces may pick another card from said set of cards.

10. An educational game in accordance with claim 6 wherein said random path contains a plurality of randomly distributed spaces labelled "Draw Again", whereby the player whose said marker lands on any one of said "Draw Again" spaces may pick another card from said deck of cards, said deck of cards containing a plurality of cards labelled "Draw Again", whereby the player drawing one of said "Draw Again" cards may advance his marker on said path to the next one of said "Draw Again" spaces.

* * * * *